US005216842A

United States Patent [19]

Phillips

[11] Patent Number: 5,216,842

[45] Date of Patent: Jun. 8, 1993

[54] GLASS GRINDING AND POLISHING MACHINE

[76] Inventor: Edwin D. Phillips, 170 Albert St., N. Plainfield, N.J. 07060

[21] Appl. No.: 719,033

[22] Filed: Jun. 21, 1991

[51] Int. Cl.[5] ..... B24B 7/16; B24B 7/02

[52] U.S. Cl. ..... 51/125; 51/215 CP; 51/283 R

[58] Field of Search ..... 51/121, 123 R, 129, 51/131.1, 283 R, 237 T, 131.3, 216 ND, 215 CP, 125

[56] References Cited

U.S. PATENT DOCUMENTS

| | | | |
|---|---|---|---|
| 53,218 | 3/1866 | Elliott | 51/283 |
| 1,401,831 | 12/1921 | Taylor | 51/131.3 |
| 3,872,626 | 3/1975 | White | 51/129 |
| 4,525,957 | 7/1985 | Daniels | 51/131.1 |
| 4,766,702 | 8/1988 | Kinner | 51/131.3 |

FOREIGN PATENT DOCUMENTS

| | | | |
|---|---|---|---|
| 1262677 | 3/1961 | France | 51/129 |

*Primary Examiner*—Bruce M. Kisliuk
*Assistant Examiner*—Bo Bounkong
*Attorney, Agent, or Firm*—Shoemaker and Mattare Ltd.

[57] ABSTRACT

A machine for grinding and polishing ends of glass articles comprises a grinding wheel mounted for rotation about a first axis, and a fixture for holding a plurality of articles to be ground by the wheel. The fixture includes a spindle rotatable about a second axis, and a work holder mounted at an end of the spindle. The work holder has a plurality of workpiece-receiving cavities circumferentially spaced around the second axis, and each cavity has an axis parallel to the second axis. The first and second axes may be parallel to one another, oblique, or perpendicular, depending on the desired product.

8 Claims, 10 Drawing Sheets

FIG. 18
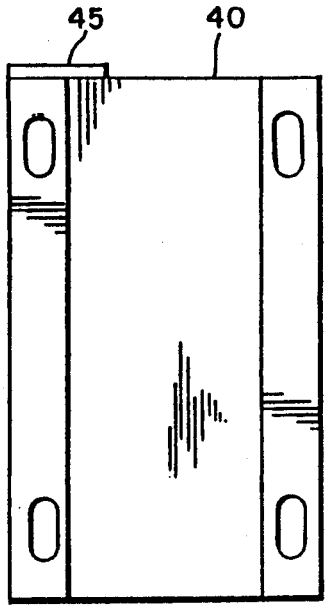
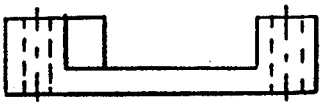
FIG. 19
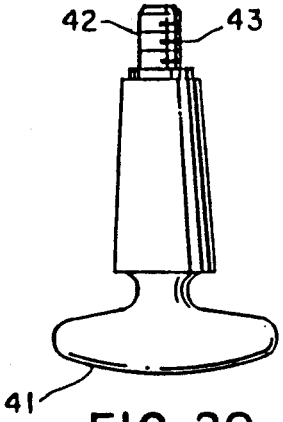
FIG. 20
FIG. 22
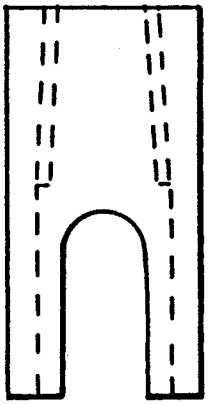
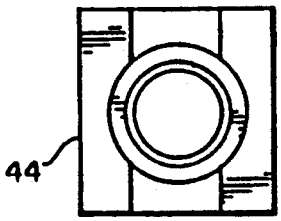
FIG. 21
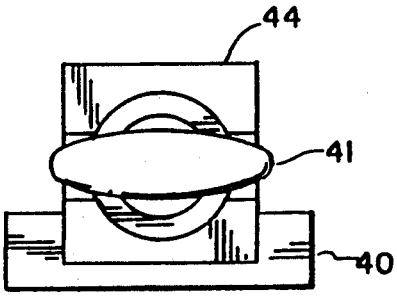
FIG. 23
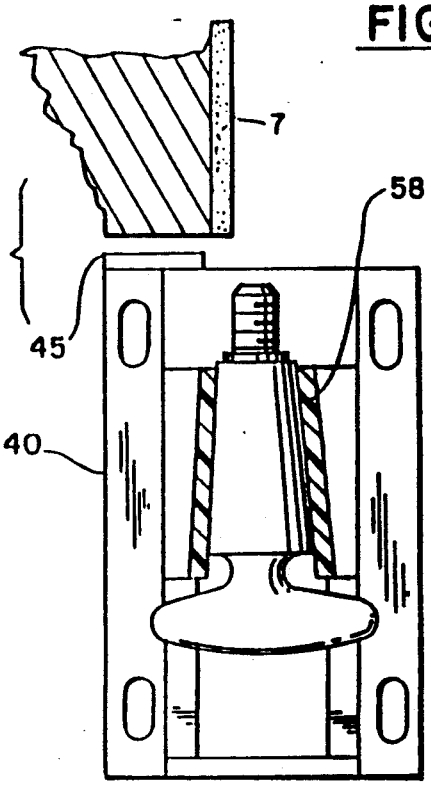
FIG. 24

FIG. 31
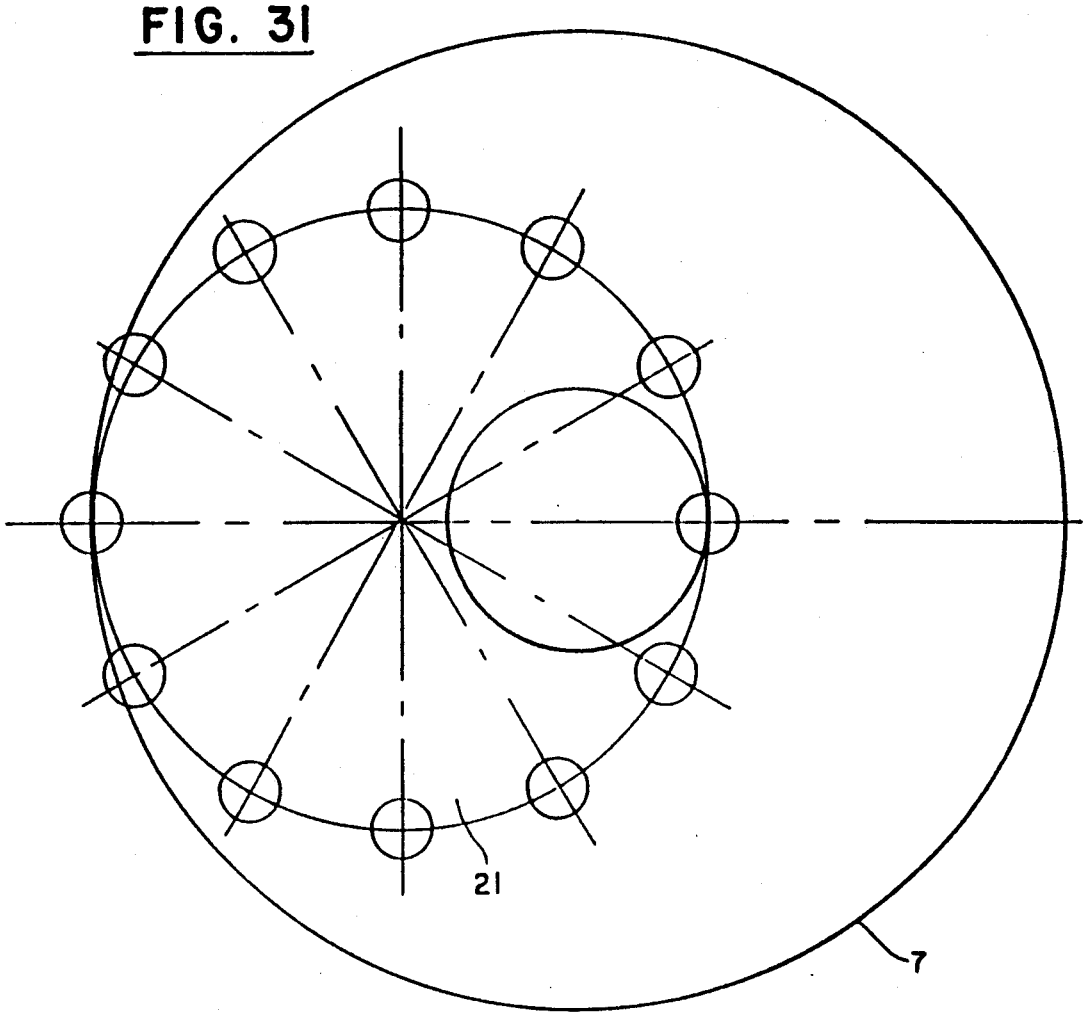
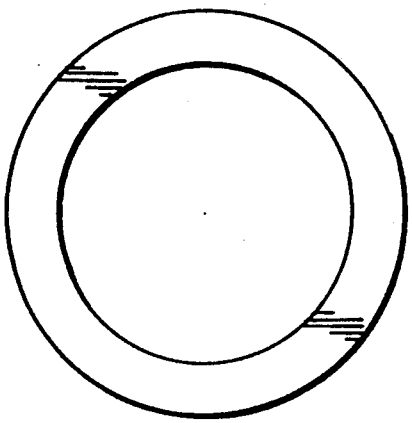
FIG. 26
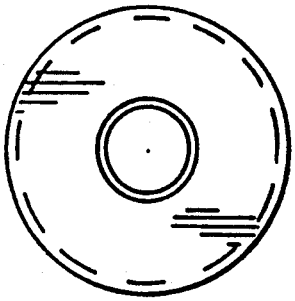
FIG. 28

GLASS GRINDING AND POLISHING MACHINE

BACKGROUND OF THE INVENTION

This invention relates generally to grinding, and more particularly to a machine for grinding the surfaces of glass or glassy objects.

Grinding and polishing machines presently on the market are generally single spindle or single purpose machines.

SUMMARY OF THE INVENTION

An object of this invention is to grind and polish, simultaneously, multiple rods or workpieces made of glass or sapphire. This object is achieved by using a Gatling Gun approach, where a number of workpieces are supported in a rotating work holder and simultaneously worked. Another object of the invention is to provide an apparatus capable of grinding end faces, chamfers, or lateral flats on workpieces, with only minor set-up. A related object is to enable one to grind workpieces of different sizes.

In the grinding of glass, it is very important that the face of the grinding wheel run absolutely dead true. If there is any vibration against the glass, chipping and breakage will result. Since the face of the bonded wheel cannot be machined after manufacture, it is necessary to provide a means of centering and truing of the wheel when mounting it to an arbor. Therefore, another object of the invention is to enable a machine operator to true the face of the grinding wheel.

A machine for grinding and polishing ends of glass articles and the like according to this invention, comprises a grinding wheel mounted for rotation about a first axis, and a fixture for holding a plurality of articles to be ground by an end face of the wheel. The fixture includes a spindle rotatable about a second axis, and at least one work holder mounted at an end of the spindle, the work holder having a plurality of workpiece-receiving cavities circumferentially spaced around the second axis. Each cavity has an axis parallel to the second axis. The machine is described in greater detail below.

In the description and drawings of the machine, diamond bonded wheels are shown. The present invention is also designed to use grinding and polishing wheels made of other materials, such as felt, optical polishing pitch, or cast iron diamond dust has been applied to their surfaces. These are all standard materials for processing sapphire, glass and other hard materials.

BRIEF DESCRIPTION OF THE DRAWINGS

In the accompanying drawings:

FIG. 18 is a plan view of a fixture for holding a stopcock while flats are ground on it;

FIG. 19 is an end view of the fixture shown in FIG. 18;

FIG. 20 is a side elevation of a stopper produced with the invention;

FIG. 21 is a side elevation of a seat for the stopper;

FIG. 22 is an ed view of the seat for the stopper shown in FIG. 21;

FIG. 23 is a view showing elements of FIGS. 18–22 in assembled configuration;

FIG. 24 is an end view of the assembled configuration shown in FIG. 23;

FIG. 26 is an end view of the fixture for holding large cylindrical objects shown in FIG. 25;

FIG. 28 is an end view of a portion of the fixture shown in FIG. 27;

FIG. 31 is a diagram showing the offset relationship between the grinding wheel axis and the axis of the fixture.

DETAILED DESCRIPTION OF THE PREFERRED EMBODIMENT

Figure 1:
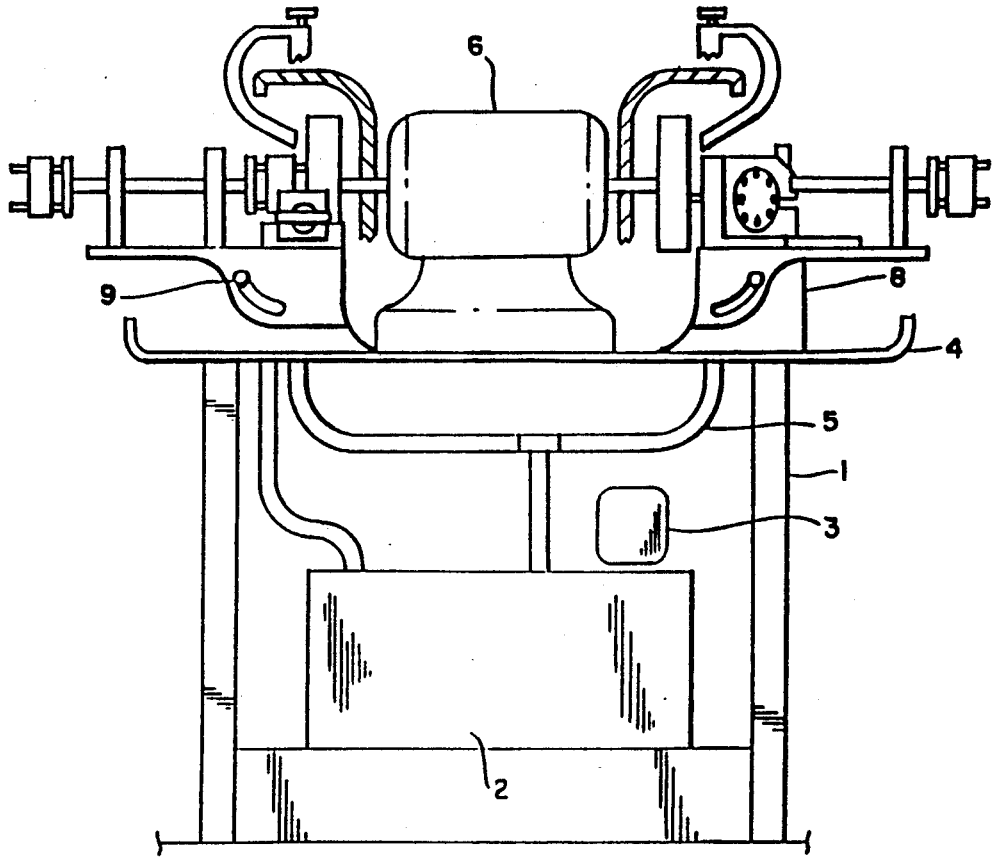
FIG. 1 is a front elevation of an apparatus embodying the invention.
Figure 2:
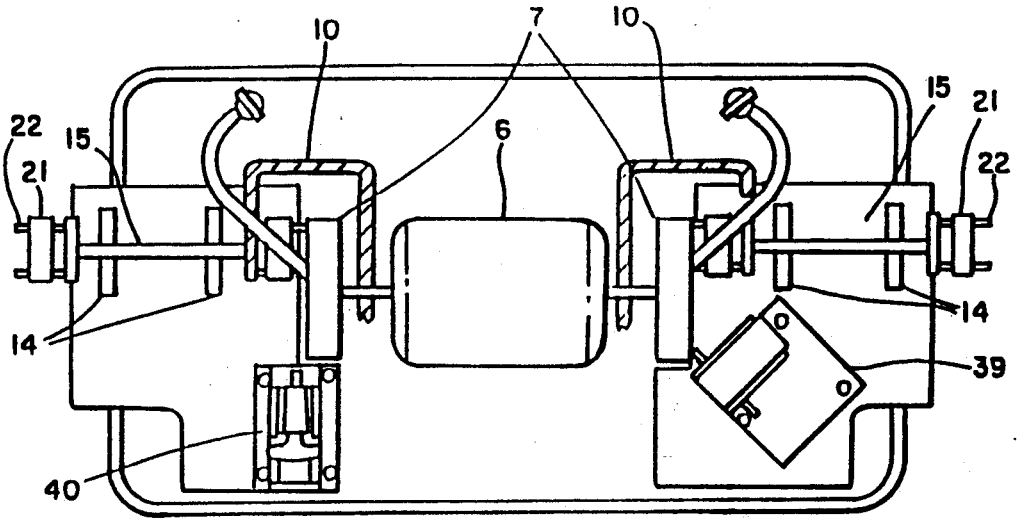
FIG. 2 is a top plan view of the apparatus in FIG. 1.
Figure 3:
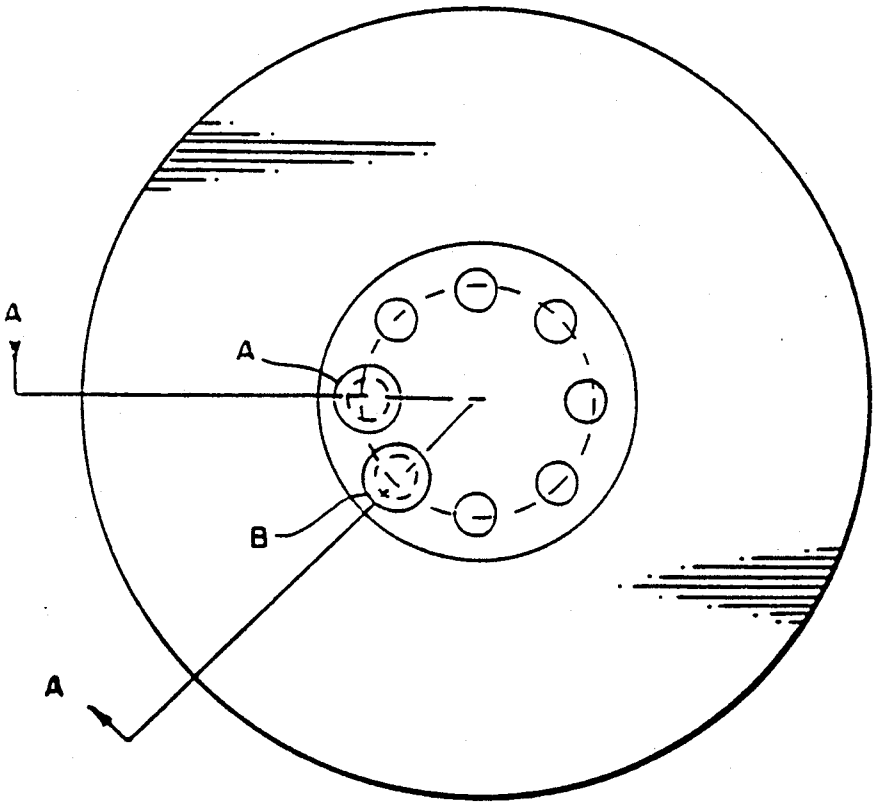
FIG. 3 is a side elevation of a grinding wheel shown in FIG. 2.
Figure 4:
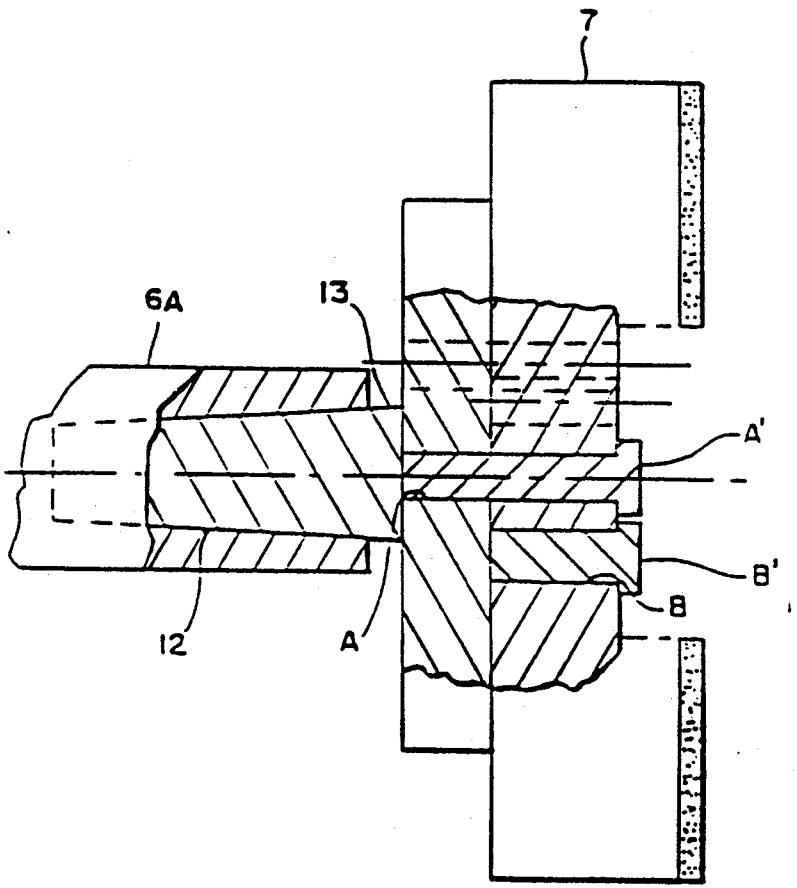
FIG. 4 is a sectional view taken along the line 4—4 in FIG. 3.

FIGS. 1 and 2 show an apparatus embodying the invention. The apparatus includes a stationary frame or base 1, which supports a water supply sump 2, a pump 3, a water catch tray 4, and piping 5 to return water to the sump. A double spindle motor 6 is mounted on the base, and a grinding wheel 7 is installed on each spindle, as described below. An internal mounting taper 12 (FIG. 4) provided at the end of each spindle allows for easy change from one size diamond wheel to another. An arbor 13 is shown installed in the taper. On the face of this arbor are four equally spaced threaded mounting screw holes A by which the diamond bonded wheel 7 is mounted to the arbor by four mounting screws A'. There are four additional threaded screw holes B in the bonded wheel. The four screws B' in holes B contact the face of the arbor and are known as "jacking screws".

The procedure of bringing the face of the diamond bonded wheel perpendicular to the centerline of the arbor is first to finger-tighten the four mounting screws A'. Then, by appropriately tightening and loosening the four jacking screws B', the face of the bonded wheel is made to run dead true with the arbor.

Figure 5:
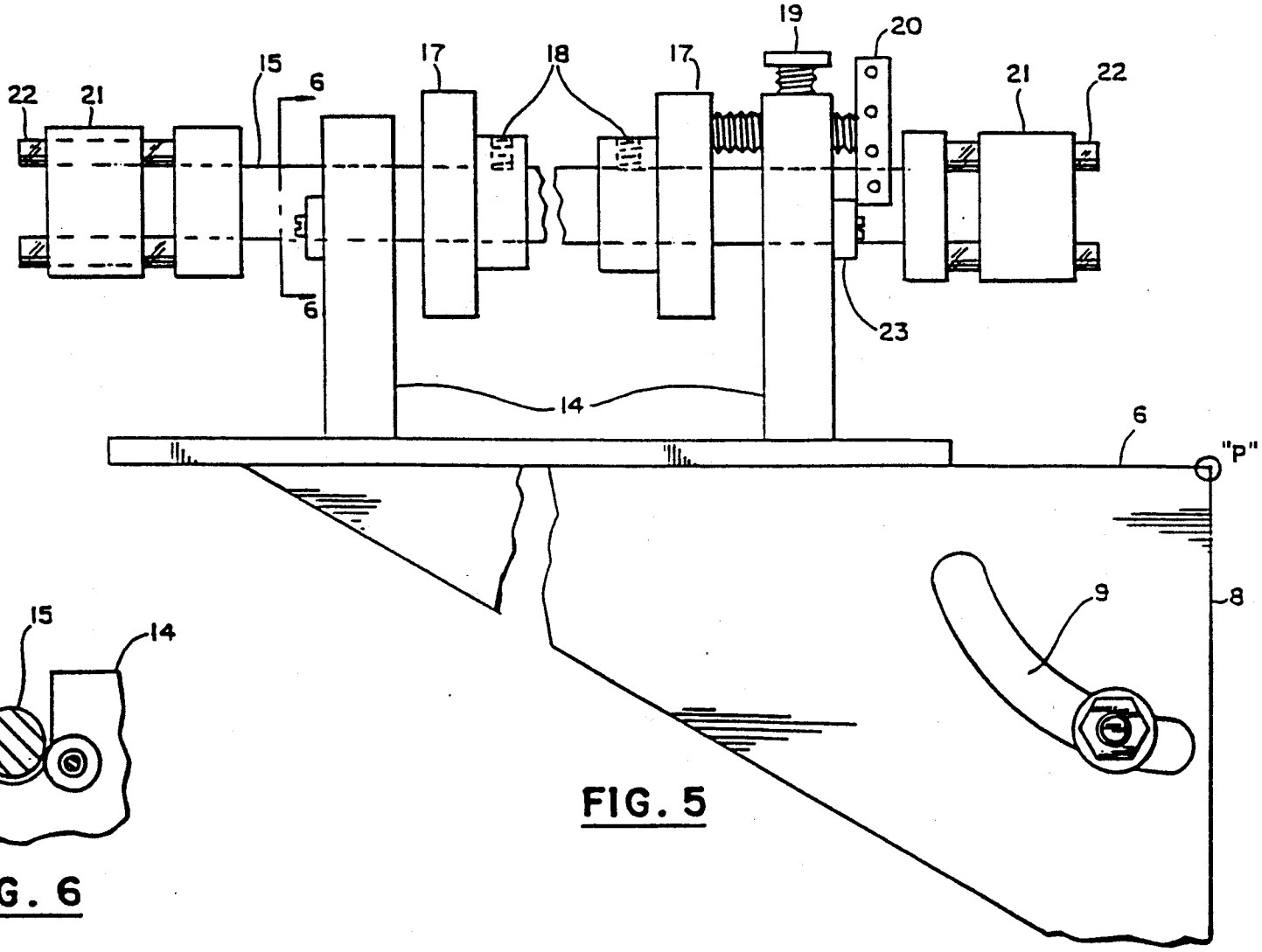
FIG. 5 is a front elevation of a portion of the apparatus.
Figure 6:
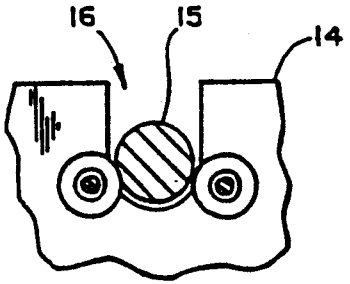
FIG. 6 is a sectional view taken along line 6—6 in FIG. 5.

FIG. 5 shows a work plate 8 which is pivotally mounted to the frame at P and has a slot 9 which permits adjustment, to bring the mounting surface of the work plate 8 perpendicular to the face of the diamond bonded wheel. Two bearing supports 14 are mounted on the work plate. In FIG. 6, the spindle assembly 15 is shown supported between two ball bearings 23 mounted on bearing blocks 14. The whole spindle assembly can be rotated while it is thus supported and can be easily removed via slot 16.

A spindle stopping device, also shown in FIG. 5, includes a micrometer screw 20 mounted on the front bearing support 14. The end of the micrometer screw comes into contact with an adjustable stopping block 17. This block is roughly adjusted and locked on to the spindle through a set screw 18. The micrometer stop is rotated to establish the precise position desired; this position is maintained by lock screw 19.

In operation, the spindle assembly is rotated as it is moved forward to bring the face of the glass rods 22 against the diamond bonded wheel. During the grinding, the length of each glass rod will be shortened until the stopping block 17 comes into contact with the face of the micrometer screw 20. Since the spindle assembly 15 is symmetrical, the assembly can be reversed that is, inverted end-for-end; glass rods 22 mounted on each end are thereby ground to uniform length.

Figure 7:
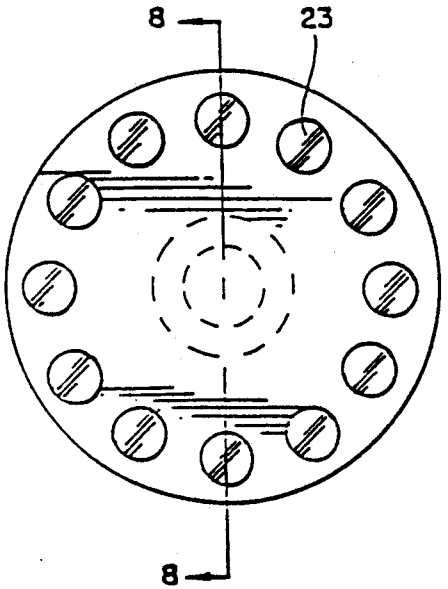
FIG. 7 is a side elevation of a modified form of the invention.
Figure 8:
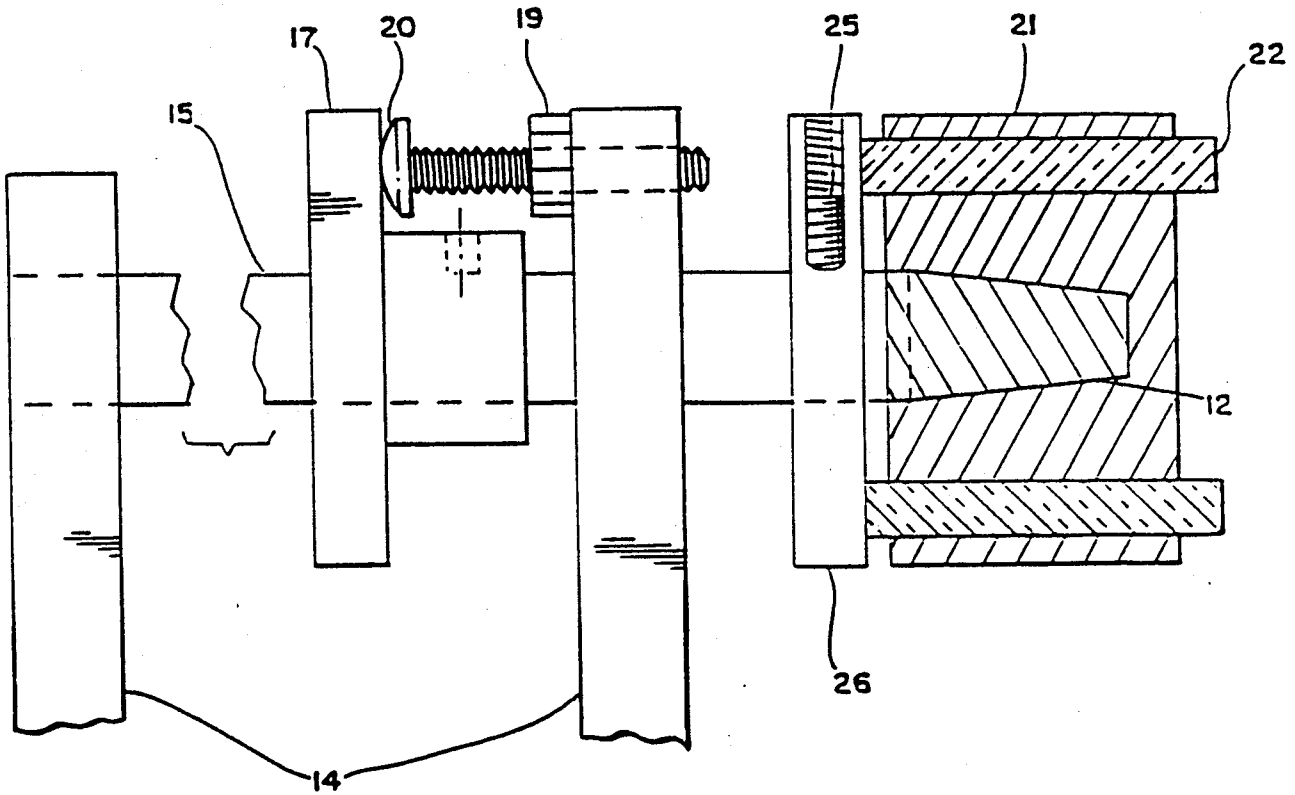
FIG. 8 is a partial sectional view thereof, taken along line 8—8 in FIG. 7.
Figure 9:
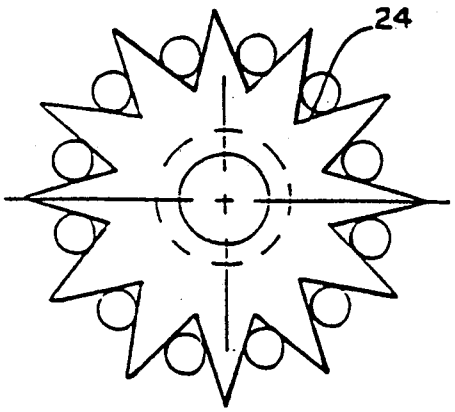
FIG. 9 is a side elevation of another modified form of the invention.

FIGS. 7 and 8 show a typical work holder 21 mounted to the spindle assembly 15. FIG. 8, showing a cross-sectional view of the work holder, illustrates a series of glass rods 22 in the holes 23, arranged around the periphery of the work holder. If, as shown, the glass rods have precise diameters, and a minimum of clearance in the holes, an additional means of holding the rods in the holes is not required.

A back up collar 26 is provided to form a reference surface to establish the overall length of the glass rods. This collar is adjustable through the use of set screw 25, thus providing a rough adjustment to accommodate a wide range of glass rod lengths. A slightly different type of length control device is also shown. The bearing support 14 is drilled and tapped for a micrometer screw 20. The same stopping block 17 is used, as shown in FIG. 5. The lock nut 19 prevents the micrometer screw from moving once it is set.

Figure 10:
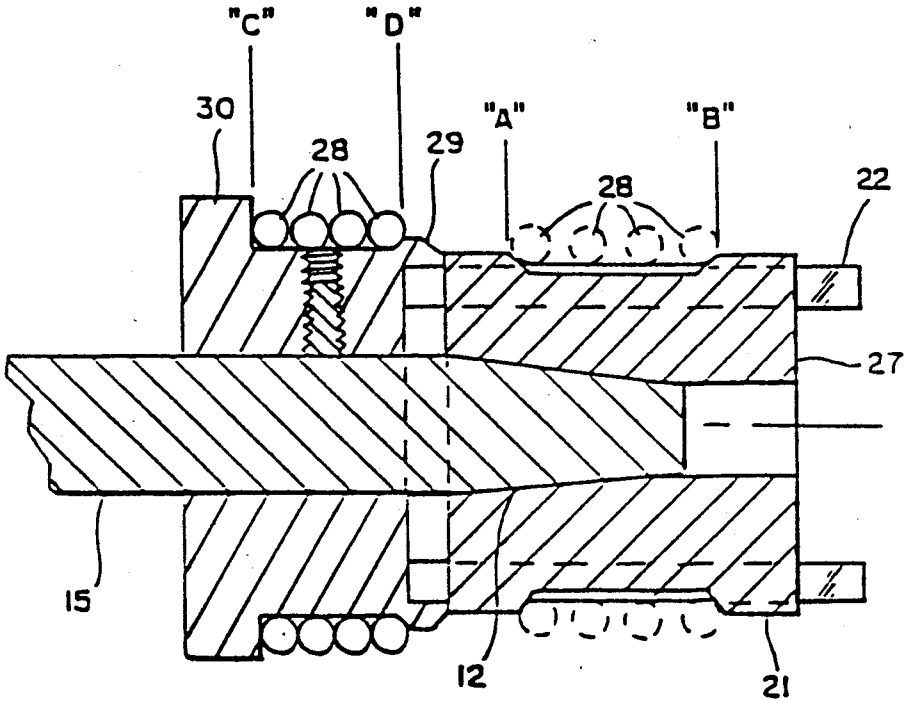
FIG. 10 is a sectional view taken along the line 10—10 in FIG. 9.

FIG. 10 is a cross-sectional view of a work holder 27 designed to hold glass rods 22 which are not precision ground and have a wider range of diameters. The work holder has a series of "V" grooves 24 cut into its periphery. A portion of the length of the outside diameter is undercut at "A"-"B". The glass rods 22 are placed into the grooves 24 and are held there by the force exerted by rubber bands or O-rings 28.

In order to facilitate loading and unloading of the glass rods, a slightly different back up collar 30 is provided to produce a loading area "C"-"D" for the rubber bands or O-rings. A ramp 29 is provided so that the rubber bands or O-rings 28 may be slid or rolled off the glass rods at "A"-"B" to area "C"-"D", thus freeing the glass rods.

Figure 11:
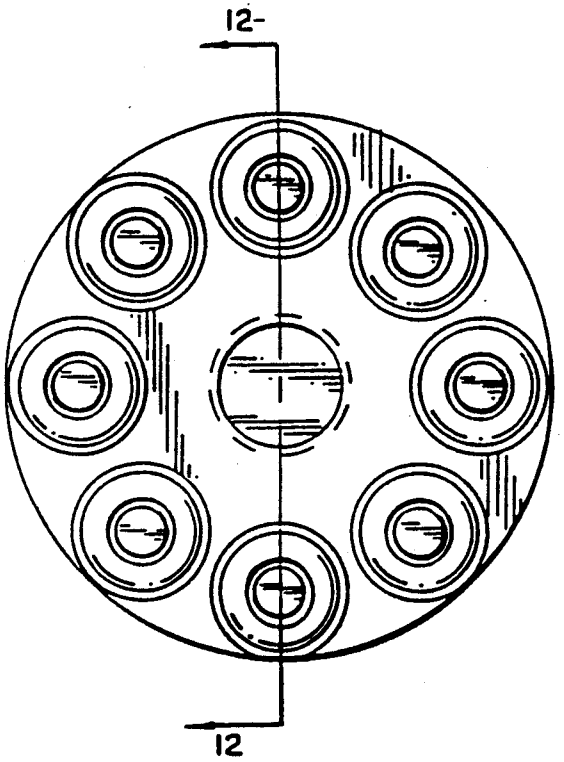
FIG. 11 is a side elevation of a further modified form of the invention.
Figure 12:
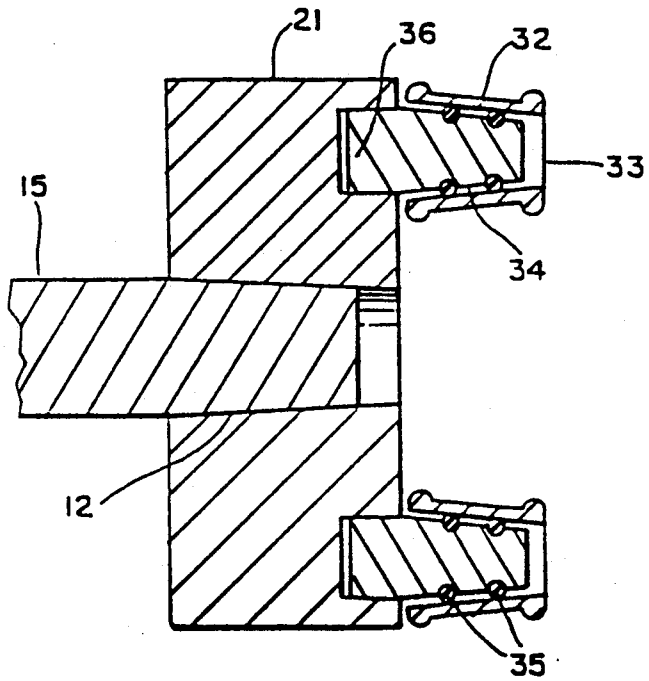
FIG. 12 is a sectional view taken along the line 12—12 in FIG. 11.
Figure 13:
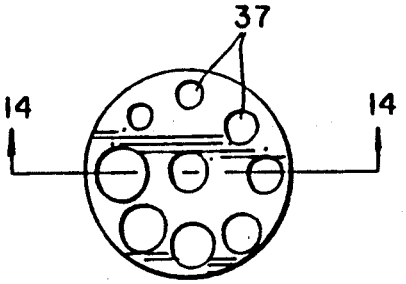
FIG. 13 is a side elevation of a portion of the apparatus.
Figure 14:
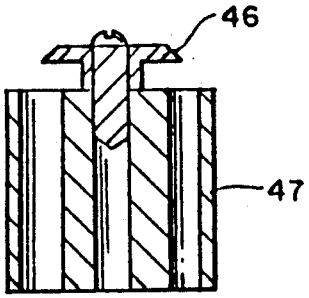
FIG. 14 is a sectional view taken along the line 14—14 in FIG. 13.
Figure 15:
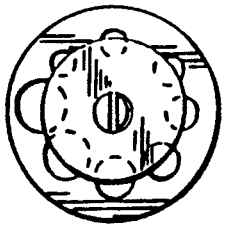
FIG. 15 is a side elevation of the device shown in FIG. 14.

FIGS. 11 and 12 show a modified form of the invention for grinding the face of the stop-cock body 32. In facing the stop-cock body, it is important to have the face square with the internal taper. The mounting shown maintains this square relationship. As shown in FIG. 12, the stop-cock body is mounted on the spindle assembly 15, and the tapered holders 36 are inserted into the work holder 21 around its periphery. The tapered holders have two grooves machined about their outside diameter for two O-rings 35. The diameters are such that when the stop-cock body 32 is placed on them, there is clearance between the internal taper of the glass body and the external surfaces 34 of the tapered work holders. In this manner, the face 33 is held perpendicular to the centerline of the taper and when the spindle assembly is placed in the machine's bearing supports 14, the face is ground square to the internal taper.

In order to grind a chamfer on a glass rod, an additional fixture is added to the base of the machine. FIGS. 13–17 illustrate this fixture 47. Plural work-receiving holes 37 are machined around the periphery. The diameters of the holes may vary by a selected increment as desired. The proper diameter hole is selected to match the diameter of the glass rods to be chamfered. It is important that the fit be such as to allow the rod to rotate easily but without being loose.

Figure 16:
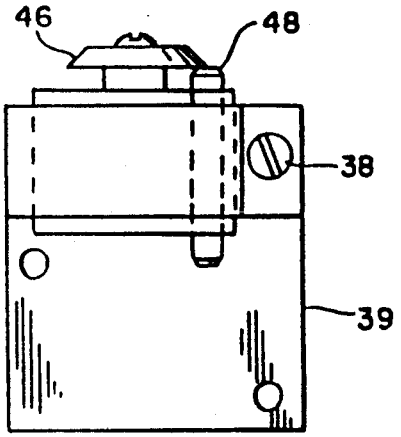
FIG. 16 is a plan view of a portion of the apparatus showing the chamfering fixture.
Figure 17:
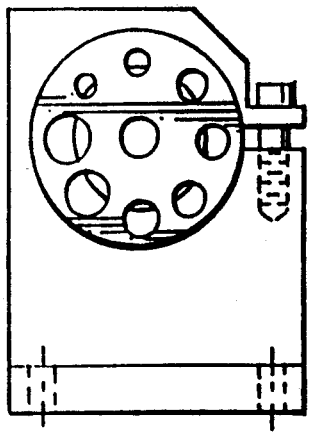
FIG. 17 is an end view of the chamfering fixture shown in FIG. 16.
Figure 25:
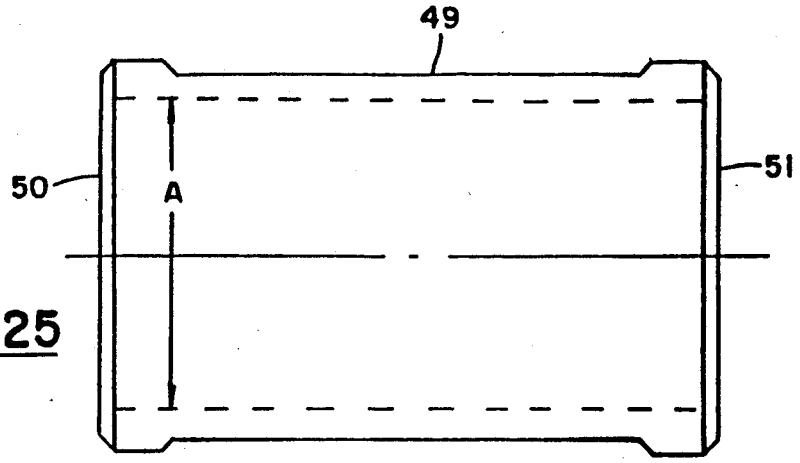
FIG. 25 is a side elevation of a fixture for holding large cylindrical objects.
Figure 27:
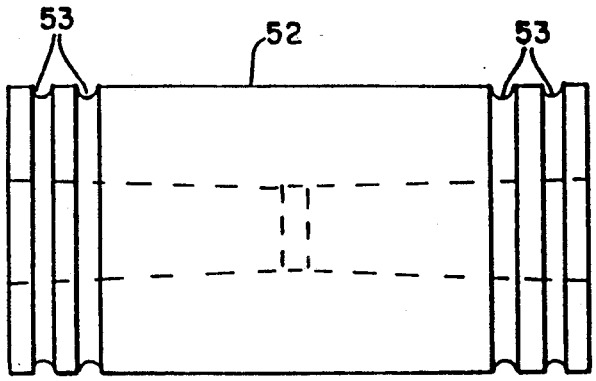
FIG. 27 is a side elevation of a portion of the fixture.

A locating circular stop 46, mounted on the face of the work holder 47, is positioned so as to stop and position any of the various size glass rods 48 relative to the grinding wheel. The assembled work holder 47 is installed into the chamfering fixture 39 and clamped into position by means of the screw 38, as shown in FIG. 16. The assembled fixture 39 is then mounted on the base of the machine at the proper angle in relation to the bonded diamond wheel 7, as shown in FIG. 1.

FIGS. 18–24 show details of a fixture required to grind two flats 42 and 43 on a glass stop-cock 41. The work holder 44 is slidable along the groove provided in the mounting block 40. A stop plate 45 is fastened to the block as shown.

FIG. 23 shows a stop-cock 41 positioned in a plastic insert 58, which is mounted in the slidable work holder 44. The assembly is mounted on the base of the machine as shown in FIG. 1.

FIG. 24 shows the fixture mounted in relation to the grinding wheel 7. The stop-cock mounted in the work holder is slid forward into contact with the bonded wheel, which grinds one flat 43 until the work holder is stopped by the stop plate 45. The work holder is then slid back until free of the grinding wheel, the stop-cock is rotated 180° and the operation is repeated in order to grind the opposite flat 42.

Figure 29:
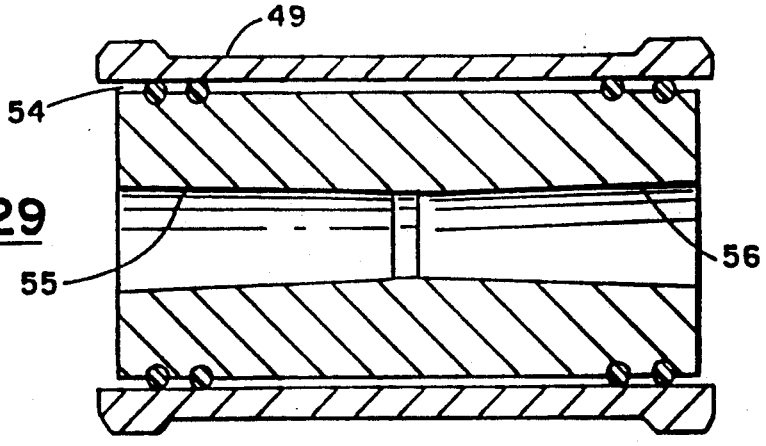
FIG. 29 is a sectional view of the elements of FIGS. 25 and 27, assembled.
Figure 30:
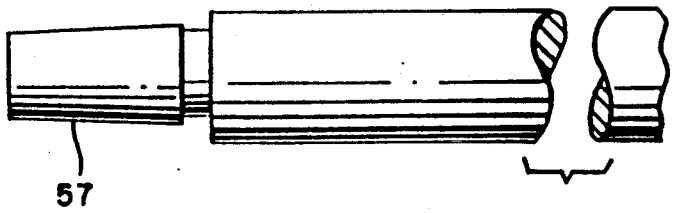
FIG. 30 is a side elevation of a spindle for supporting the fixture.

Large cylindrical workpieces are more conveniently handled individually—one such glass cylinder 49 is shown in FIGS. 15–30. In this case, the faces 50 and 51 must be ground perpendicular to the centerline of the internal diameter "A" and parallel to each other. A fixture 52 is provided which has four O-ring grooves 53 machined about its outside diameter as shown. In the cross-sectional view of FIG. 29, the cylinder 49 is shown in position on the fixture with the four O-rings in place. The diameter of the machined O-ring grooves and the O-ring cross-section is made so that a space 54 is provided to ensure that the inside diameter "A" is centered on the fixture.

The fixture 52 is fitted with two internal tapers 55 and 56, which are made to fit onto the matching taper 57 mounted on the spindle. After one face 50 of the workpiece is ground, the fixture is reversed, whereupon face 51 is ground and polished without the cylinder 49 having been removed from the fixture.

A very important consideration in grinding all of the various glass pieces is to keep the diameter of the bonded diamond wheel as small as practical since the cost of the wheel is an exponential function of the diameter. Another important consideration is that the face of the grinding wheel be worn evenly. FIG. 31 shows a pattern of work pieces in relation to the grinding wheel that will meet all of the requirements of allowing the greatest number of glass rods to be used with the smallest diameter grinding wheel 7 that will produce a uniform work to the grinding or polishing wheel.

Inasmuch as the invention is subject to modifications and variations, it is intended that the foregoing description and the accompanying drawings shall be interpreted as illustrative of only one form of the invention, whose scope is to be measured by the following claims.

I claim:

1. A machine for grinding and polishing ends of glass articles comprising a grinding wheel mounted for rotation about a first axis, and having an end grinding face perpendicular to said axis, means for turning said wheel, a fixture for holding a plurality of articles to be ground by said wheel, said fixture comprising a spindle rotatable about a second axis, wherein said spindle is supported at its middle and has two ends, each supporting a respective work holder, at least one work holder having a plurality of workpiece-receiving cavities circumferentially spaced around said second axis, each cavity having an axis parallel to said second axis, and said articles being movable toward said grinding wheel face, and means on said spindle for limiting the movement of said work holder toward said grinding wheel, whereby the articles can be ground to precise, uniform lengths.

2. The invention of claim 1, wherein said spindle can be reversed so that articles supported on either of said spindle ends can be ground.

3. The invention of claim 2, wherein each of said cavities is a through hole parallel to the axis of the spindle, and further comprising a stop collar mounted on said spindle for abutting the ends of the glass articles remote from the grinding wheel, and means for locking said collar on said spindle at adjustable points therealong.

4. The invention of claim 2, further comprising means for limiting the movement of said work holder towards said grinding wheel face.

5. A machine for grinding a polishing ends of glass articles, comprising a frame, a motor mounted on said frame and having shafts protruding from either end thereof, said shaft having a common first axis, two grinding wheels, each mounted on a respective one of said shafts, and each having an end grinding face perpendicular to said first axis and facing away from said motor, a pair of fixtures for holding a plurality of articles to be ground by said wheel, each of said fixtures comprising a rotatable spindle, a work holder mounted at each end of each spindle, said work holder having plural cavities for receiving said articles, said work holder being movable toward said grinding wheel face, and means on said spindle for limiting the movement of said work holder toward said grinding wheel, whereby the articles can be ground to precise, uniform lengths.

6. The apparatus of claim 5, further comprising a device for holding a workpiece on an axis oblique to the face of the grinding wheel.

7. the apparatus of claim 5, further comprising a device for holding a workpiece on an axis parallel to the face of the grinding wheel, whereby flats can be ground on said workpiece.

8. The invention of claim 5, wherein each of said cavities is a through hole parallel to the axis of the spindle, and further comprising a stop collar mounted on said spindle for abutting the ends of the glass articles remote from the grinding wheel, and means for locking said collar on said spindle at adjustable points therealong.

* * * * *